US005333442A

United States Patent [19]

Berger

[11] Patent Number: 5,333,442

[45] Date of Patent: Aug. 2, 1994

[54] METHOD FOR PRODUCING A ROPE HAVING SUPERIOR FRICTION AND WEARING RESISTANCE

[75] Inventor: George A. Berger, Lafayette, La.

[73] Assignee: American Manufacturing Company, Inc., Lafayette, La.

[21] Appl. No.: 973,733

[22] Filed: Nov. 9, 1992

Related U.S. Application Data

[60] Division of Ser. No. 833,611, Feb. 13, 1992, Pat. No. 5,199,253, which is a continuation of Ser. No. 553,883, Jul. 16, 1990, abandoned.

[51] Int. Cl.[5] ..... D02G 3/02; D02G 3/36

[52] U.S. Cl. ..... 57/314; 57/1 R; 57/231; 57/236; 57/237; 57/238; 57/244; 57/248; 87/8

[58] Field of Search ..... 57/314, 1 R, 230, 231, 57/236, 237, 238, 244, 248; 87/8

[56] References Cited

U.S. PATENT DOCUMENTS

| | | | |
|---|---|---|---|
| 1,604,075 | 10/1926 | Reisenberg | 57/230 |
| 1,660,065 | 2/1928 | Brewster | 57/230 X |
| 2,134,022 | 10/1938 | Bell | 57/237 |
| 2,190,854 | 2/1940 | Whitlock | 57/230 X |
| 2,591,628 | 4/1952 | Snyder et al. | 57/211 |
| 3,010,275 | 11/1961 | Hartmann et al. | 57/231 |
| 3,201,930 | 8/1965 | Stirling | 57/230 X |
| 3,315,455 | 4/1967 | Stoller | 57/231 X |
| 3,323,301 | 6/1967 | Jackson | 57/230 |
| 3,389,548 | 6/1968 | Lachaussee et al. | 57/244 |
| 3,415,052 | 12/1968 | Stanton | 57/231 |
| 3,691,751 | 9/1972 | Hiller et al. | 57/145 |
| 3,778,993 | 12/1973 | Glusnko et al. | 57/145 |
| 4,055,941 | 11/1977 | Rivers et al. | 57/251 |
| 4,058,049 | 11/1977 | Bech | 57/202 |
| 4,263,777 | 4/1981 | Wada et al. | 57/253 X |
| 4,317,000 | 2/1982 | Ferer | 174/70 R |
| 4,405,686 | 9/1983 | Kuroda et al. | 428/370 X |
| 4,412,474 | 11/1983 | Nara | 87/6 |
| 4,709,544 | 12/1987 | Charvet | 57/236 X |
| 4,801,503 | 1/1989 | Jennings | 57/253 X |
| 4,929,503 | 5/1990 | Snirasaki et al. | 428/373 |
| 5,199,253 | 4/1993 | Berger | 57/236 |

*Primary Examiner*—Daniel P. Stodola
*Assistant Examiner*—William Stryjewski
*Attorney, Agent, or Firm*—Louis Weinstein

[57] ABSTRACT

A multi-strand nylon rope having improved abrasion resistance is comprised of a plurality of strands. Each strand is comprised of a plurality of yarns wherein each yarn is formed of a predetermined number of filaments. The filaments of each yarn are twisted together to form a yarn of a predetermined size, the twist direction being opposite that of the final ply yarn direction. For a right lay rope a sufficient number of filaments are twisted together in the left or "S" direction to produce a yarn of a predetermined size. Three or more yarns prepared in this manner are then plied or twisted together in the opposite or right direction. The cover for each strand is formed of alternate yarns of standard (i.e. round) and oblong filaments, respectively, the oblong filaments having a modification ratio of three, forming a rope having increased abrasion resistance, a hand and feel that is not stiff or unmanageable and which resists strand-to-strand wet abrasion.

9 Claims, 3 Drawing Sheets

METHOD FOR PRODUCING A ROPE HAVING SUPERIOR FRICTION AND WEARING RESISTANCE

This is a division of application Ser. No. 07/833,611, filed Feb. 13, 1992, now U.S. Pat. No. 5,199,253, which is a continuation of application Ser. No. 07/553,883, filed Jul. 16, 1990 and now abandoned.

FIELD OF THE INVENTION

The present invention relates to rope, and more particularly, to multiple strand nylon rope, each strand being formed of a plurality of yarns and having alternating cover yarns of the first and second types respectively formed of filaments which have round and oblong cross-sections.

BACKGROUND OF THE INVENTION

The present invention relates to cordage, and more particularly, to an improved rope made of nylon.

Nylon ropes have been in use for many years. Nylon is known to provide strong, elastic rope fibers. Rope formed of nylon provides excellent shock absorption, withstanding dynamic loads that have been found to break other ropes. Nylon has good resistance to abrasion, rot, mildew, marine growth, petroleum products, and most chemicals and is widely used in the marine industry as anchor, mooring, shock and towing lines. Nylon rope construction is typically produced in three or four strand twisted, eight strand plaited and solid braid and are satisfactory in most applications.

Nevertheless, nylon ropes experience significant wearing due to wet abrasion. More particularly, abrasion caused by contact of the rope with another surface such as a bollard, cleat or other metal surface is accelerated when the nylon rope is wet.

Techniques for protecting the rope against wearing have included coating the rope or applying another covering such as a canvas or leather sleeve. These techniques are unsatisfactory since they increase production costs of the rope and further tend to affect the stiffness and hand of the rope.

BRIEF DESCRIPTION OF THE INVENTION

The present invention is directed to providing a rope which significantly increases the resistance of rope and particularly nylon rope to abrasion with the structure of said rope being characterized by comprising strands which are twisted together wherein each strand is formed of a plurality of twisted yarns. A first group of yarns comprise the core of a strand while a second group of yarns collectively form a cover for the strands. The core yarns and alternating ones of the cover yarns encircling the core yarns are formed of substantially the same filaments. The remaining alternating yarns forming the strand cover are each comprised of obround filaments.

For a right lay rope the yarns are twisted in the left or "S" direction. Three or more such yarns are then plied, or twisted together in the opposite or right (i.e. "Z") direction.

The yarns are then placed in a rope machine and positioned to produce a strand. The strands are then twisted together in the "Z" direction to form a multistrand rope.

The cover yarns formed of obround filaments provide an abrasion resistance superior to that of the round filaments. However, the obround filaments are stiff and would otherwise form unmanageable rope if the cover yarns were made of 100 percent obround filaments.

A cover layer constructed employing alternating yarns respectively formed of round and obround filament yields a rope having: increased abrasion resistance compared with ropes containing only round filaments; a hand or feel that is not stiff and unmanageable; and increased resistance to strand-to-strand wet abrasion as well as surface wearing.

In the preferred embodiment, the rope is formed of nylon filaments of round and obround construction.

OBJECTS OF THE INVENTION

It is, therefore, one object of the present invention to provide a novel rope structure formed of strands having a novel cover layer adapted to significantly increase the wet abrasion resistance of the rope.

Still another object of the present invention is to provide a novel rope structure comprised of a plurality of twisted strands wherein each strand is provided with yarns forming a cover layer wherein alternating yarns of the cover layer are respectively formed of different filaments.

Still another object of the present invention is to provide a novel rope structure comprised of a plurality of twisted strands wherein each strand is provided with yarns forming a cover layer for the yarns forming the cove of each strand wherein alternating yarns of the cover layer are respectively formed of different filaments wherein said filaments are respectively round and obround.

Still another object of the present invention is to provide a nylon rope having a novel construction for yielding excellent wet abrasion resistance in which the twisted strands of the rope are each formed of a plurality of twisted yarns, and having a cover layer of twisted yarns wherein alternating yarns of the cover layer are respectively formed of different nylon filaments.

Still another object of the present invention is to provide a nylon rope having a novel construction for yielding excellent wet abrasion resistance in which the twisted strands of the rope are each formed of a plurality of twisted yarns, and having a cover layer of twisted yarns wherein alternating yarns of the cover layer are respectively formed of different nylon filaments wherein said filaments are respectively round and obround.

BRIEF DESCRIPTION OF THE FIGURES

The above, as well as other objects of the present invention will become apparent when reading the accompanying description and drawings, in which.

DETAILED DESCRIPTION OF THE INVENTION

Figure 1A:
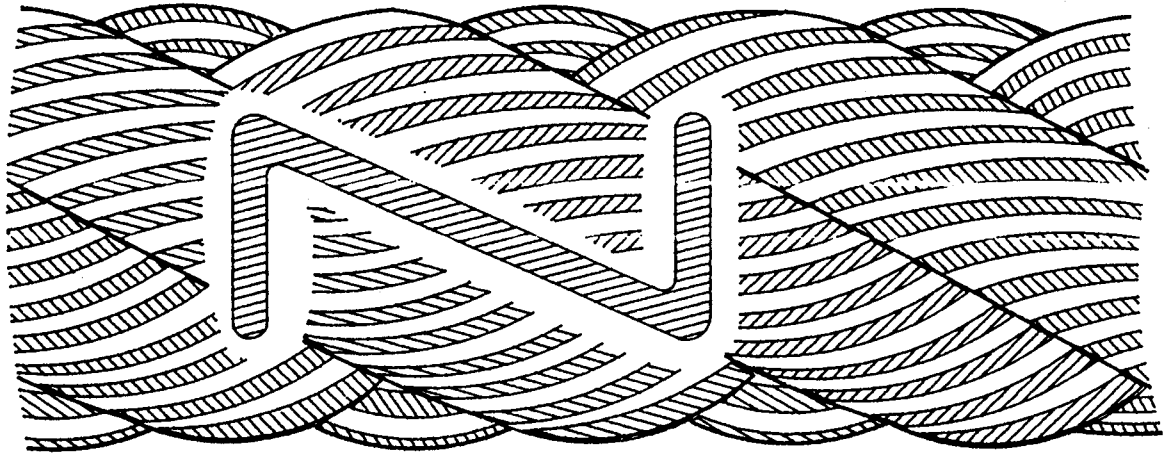
FIG. 1*a* shows a longitudinal view of a section of three strand twisted rope embodying the principles and design structures of the present invention.
Figure 1B:
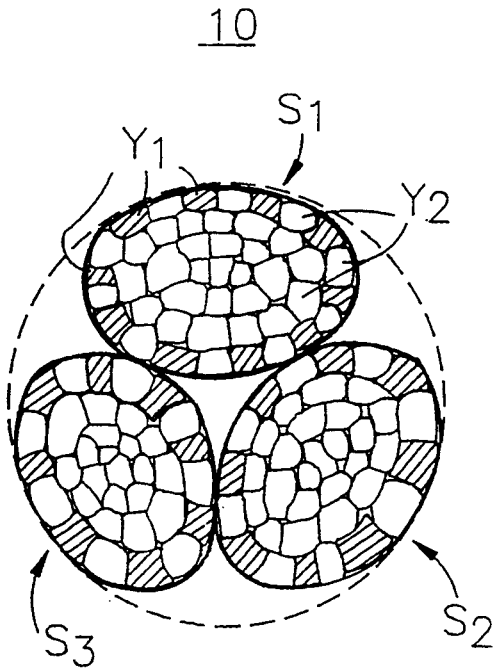
FIG. 1*b* shows a cross-sectional view of the rope of FIG. 1*a;*

FIGS. 1*a* and 1*b* show a three strand twisted rope 10 embodying the principles of the present invention. Rope 10 is comprised of three strands S1 , S2 and S3 which are all substantially identical in design and are twisted together in the "Z" direction as shown in FIG. 1*a*. For this reason, the construction of only one of the strands will be described herein for purposes of brevity.

Strand S1 is comprised of a plurality of yarns of first and second types. Yarns Y1, shown shaded, are utilized as cover yarns for strand S1. Yarns Y2 form the center or core of the strand as well as serving as a cover yarn. The yarns Y1 and Y2 forming the cover yarns are arranged in alternating fashion and surround the core yarns Y2 in the manner shown in FIG. 1*b*.

In the preferred embodiment, two different nylon fibers (i.e. filaments) with different cross-sections are utilized for constructing rope 10.

The yarns Y2, in the preferred embodiment, are formed of either "standard" industrial nylon or 192 filament/1260 denier nylon. A sufficient number of the filaments are twisted together to produce a yarn of a predetermined size with the filaments being twisted in the direction opposite that of the final ply yarn direction. Three or more such yarns are then plied or twisted together in the opposite direction. For example, when forming a right lay rope the filaments of a yarn are twisted in the left or "S" direction. Three or more such yarns are then plied or twisted together in the opposite or right (i.e. "Z") direction.

The Y1 yarns, which are only used to form the cover yarns for each strand, are preferably formed of a nylon identified by the trademark "HYTEN" manufactured by DuPont. These yarns are prepared in a manner similar to the preparation of the standard nylon yarn. Filaments of a predetermined size or denier are twisted together. The twist direction is the same as that employed for the standard nylon yarns. Once the single yarns are prepared they are grouped and plied or twisted together in the opposite or right direction.

Figure 3:
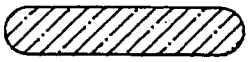
FIGS. 3 and 4 show sectional views of two types of filaments utilized in the construction of the ropes of FIG. 1*b* and 2*b*.
Figure 4:
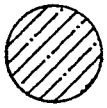

The filaments of the standard nylon have a circular cross-section as shown in FIG. 4. The filaments employed in the strands Y1 are obround as shown in FIG. 3. The obround filaments, which have flat parallel sides and round ends, preferably have a modification ratio (i.e. width to thickness) which is of the order of 3.0. The filaments employed to form the yarns Y2 are preferably a standard 1260 denier, 192 filament. The obround filaments are produced in deniers from 2000 to 6000.

After preparation of the yarns Y1 and Y2 in the manner described hereinabove, they are then placed in a rope machine in order to produce a strand similar to those shown in FIG. 1*b*. The strands Y1 and Y2 formed in the manner described hereinabove are placed in a rope machine (not shown for purposes of simplicity) and positioned to produce a rope such as shown in FIG. 1*b* wherein a plurality of Y2 strands form the core or inner portion of the strands S1–S3. The strand cover is comprised of alternating yarns Y1 and Y2.

Each of the strands S1, S2 and S3 are substantially identical to one another and are twisted together in the "Z" direction ( to form a right lay rope).

Figure 2B:
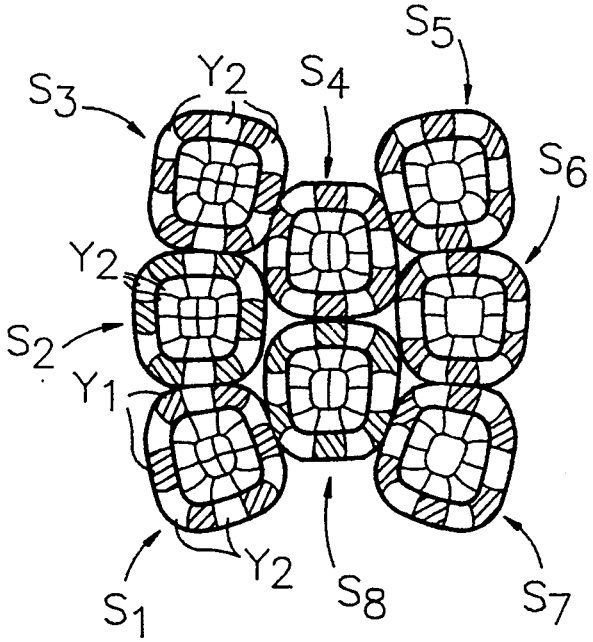
FIG. 2*b* shows a cross-sectional view of the rope of FIG. 2*a*.
Figure 2A:
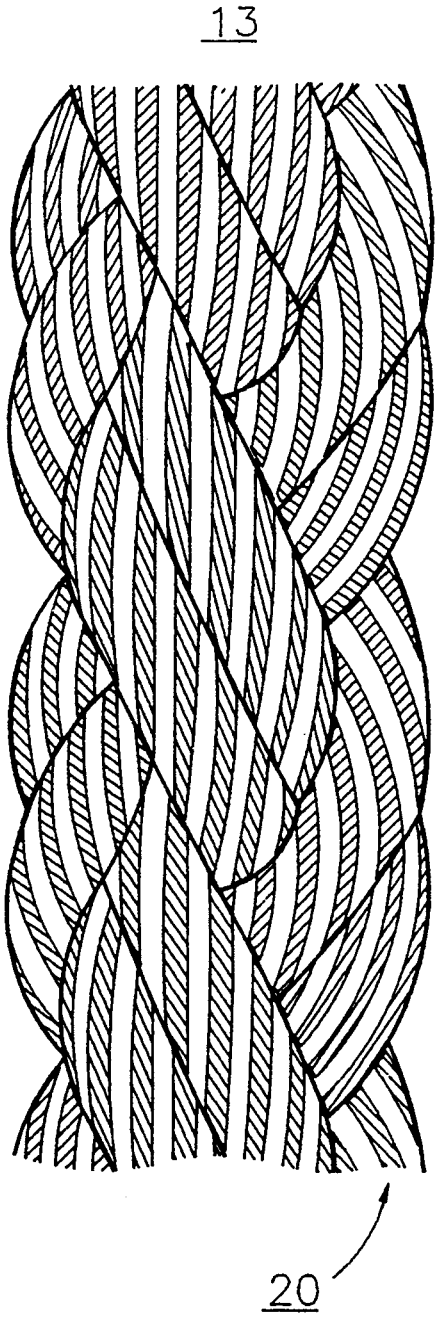
FIG. 2*a* shows a longitudinal view of a section of an eight strand braided rope embodying the principles of the present invention.

FIG. 2 shows an eight strand braided rope 20 embodying the principles of the present invention and comprised of eight strands S1 through S8, each strand formed of yarns Y1 (shown shaded) and Y2 which are formed in a manner similar to the yarns Y1 and Y2 in the embodiment 10 of FIGS. 1*a* and 1*b*.

Although the preferred embodiments shown herein are three strand and eight strand braided rope, it should be understood that other conventional structures may be utilized such as twelve strand and double braid nylon rope, while employing the principles of the present invention.

Nylon rope embodying the principles of the present invention exhibit the characteristics of increased abrasion resistance as compared with conventional nylon ropes, a hand and feel that is not stiff or unmanageable and excellent resistance to strand-to-strand wet abrasion.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method for producing a multi-strand, all-nylon rope having superior resistance to abrasion and particularly wet abrasion, comprising the steps of:

(a) forming a predetermined number of a first type of nylon filaments of a first cross-sectional shape;

(b) twisting a group of filaments formed in step (a) into a first yarn;

(c) forming a predetermined number of nylon filaments of a second cross-sectional shape different from said first cross-sectional shape;

(d) twisting a group of filaments formed in accordance with step (c) into a second yarn;

(e) forming a strand central portion from a plurality of said first yarns wherein said strand central portion has a substantially circular cross-section and is comprised of a central portion of first yarns formed of only said first type of filament;

(f) forming a cover layer about the central portion by arranging first and second yarns in alternating fashion around the periphery of said central portion thereby forming a cover layer; and (g) joining a plurality of strands formed by steps (a) through (f) into a multi-strand rope.

2. The method of claim 1 wherein step (g) further comprises the step of twisting said strands together.

3. The method of claim 1 wherein step (g) further comprises the step of braiding said strands together.

4. The method of claim 1 wherein step (a) further comprises the step of forming said first type of filaments of a denier of the order of 1250.

5. The method of claim 4 wherein step (c) further comprises forming the second type of filaments of a denier substantially greater than the denier of said first type of filaments.

6. The method of claim 1 wherein step (c) further comprises the step of forming the second type of filament of a denier in the range from 2000 to 6000 denier.

7. The method of claim 1 wherein step (a) further comprises forming the filaments to provide a substantially circular cross-sectional shape.

8. The method of claim 1 wherein step (c) further comprises forming the filaments to provide a non-circular shape.

9. The method of claim 1 wherein step (c) further comprises forming the filaments to provide an obround shape.

* * * * *

UNITED STATES PATENT AND TRADEMARK OFFICE

CERTIFICATE OF CORRECTION

PATENT NO. : 5,333,442

DATED : August 2, 1994

INVENTOR(S) : George A. Berger

It is certified that error appears in the above-indentified patent and that said Letters Patent is hereby corrected as shown below:

Column 1, line 15, delete "the".
Column 2, lines 5-6, change "filament" to --filaments--.
Column 2, line 23, after "layer" insert --for the yarns forming the core of each strand--.
Column 2, line 30, change "cove" to --core--.

Signed and Sealed this

Eleventh Day of April, 1995

Bruce Lehman

*Attest:*

BRUCE LEHMAN

*Attesting Officer*

*Commissioner of Patents and Trademarks*